US005924570A

United States Patent [19]

Sickles

[11] Patent Number: 5,924,570

[45] Date of Patent: Jul. 20, 1999

[54] HOLDER FOR A STRING OF LIGHTS

[76] Inventor: Diann Sickles, 807 Kristin Ct., Gurnee, Ill. 60081

[21] Appl. No.: 08/891,374

[22] Filed: Jul. 11, 1997

Related U.S. Application Data

[63] Continuation-in-part of application No. 08/751,840, Nov. 18, 1996, abandoned.

[51] Int. Cl.[6] ..... B65D 85/42

[52] U.S. Cl. ..... 206/419; 206/702

[58] Field of Search ..... 206/388, 418–422, 206/701, 702; 211/26; 362/249

[56] References Cited

U.S. PATENT DOCUMENTS

| | | | |
|---|---|---|---|
| 671,823 | 4/1901 | Gray | 229/93 |
| 919,715 | 4/1909 | Gray | 229/93 |
| 1,434,322 | 10/1922 | Wigzell | 220/300 |
| 2,949,182 | 8/1960 | Williams | 206/718 |
| 3,384,227 | 5/1968 | Spatz | 206/420 |
| 3,799,426 | 3/1974 | Pates et al. | 229/4.5 |
| 5,421,457 | 6/1995 | Listenberger | 206/388 |
| 5,641,075 | 6/1997 | Mechlin | 206/419 |
| 5,676,250 | 10/1997 | Walters | 206/419 |

*Primary Examiner*—Jim Foster
*Attorney, Agent, or Firm*—Welsh & Katz, Ltd.

[57] ABSTRACT

A holder for a string of lights including an elongated tube having an outer circumference convenient for winding the string of lights around. The elongated tube includes an open-ended slot parallel to a predominant axis of the tube extending from and end of the tube towards a central portion for receiving an end plug of the string of lights. The holder also includes a keeper of a diameter sufficient to form an interference fit with the ends of the tube when slid over the ends of the tube for trapping the end plug of the string of lights in the slot.

2 Claims, 3 Drawing Sheets

HOLDER FOR A STRING OF LIGHTS

This is a continuation-in-part of U.S. application Ser. No. 08/751,840, filed on Nov. 18, 1996, now abandoned.

FIELD OF THE INVENTION

The field of the invention relates to light holders and more particularly to a holder for a string of Christmas tree lights.

BACKGROUND OF THE INVENTION

Packaging for light strings (e.g., Christmas tree lights) from a manufacturer is generally not reusable. Often the packaging is made of plastic and is originally loaded by machine by the manufacturer in a manner that cannot be duplicated by a user when it becomes time to put the lights away at an end of a holiday season. Consequently, the user often coils the light string after use and puts the coil into a bag for use the following year.

When it becomes time to use the lights the following year, into the user often finds that the coil has become tangled and the user experiences great difficulty in uncoiling the lights. Often a great deal of time is spent uncoiling the lights. Light bulbs are often dislodged from sockets or become broken in frustration during the uncoiling process.

Prior teachings have included the use of a hollow cylinder with a number of holes around the periphery of the cylinder for insertion of the lights of the light string. A slot is provided on one end to secure a plug on the end of the string of lights.

Other apparatus provided in the prior art includes a flat rectangular frame with a number of notches along two opposing outer edges. A second set of notches is provided along an inner circumference of the frame for securing the plugs.

In other unrelated arts, cord holders have been provided where a cord is stored inside a first hollow cylinder. Dust caps are provided at each end to keep out dirt. A second cylinder with slots on each end is provided around which to wind the cord before insertion of the second cylinder inside the first hollow cylinder and attachment of the dust caps.

While the prior art has provided a number of devices for holding cords which may reduce a user's frustration, the devices provided are generally not adaptable for light strings or easily adapted for use in automated manufacturing processes. Accordingly, a need exists for a holder for light strings that may be cheaply and easily adapted to a manufacturer's packaging equipment, yet remains simple enough for a user to reuse at an end of a season for convenient and easy light storage.

SUMMARY OF THE INVENTION

Accordingly, it is an object of the invention to provide a holder for light strings that is simple enough for use by a consumer.

It is a further object of the invention to provide a holder for light strings that is adaptable to a manufacturer's automated processes.

These and other objects are provided by a novel holder for a string of lights. The holder includes an elongated tube having an outer circumference convenient for winding the string of lights around. An open-ended slot parallel to a predominant axis of the tube extends from an end of the tube towards a central portion for receiving an end plug of the string of lights. The holder also includes a keeper of a diameter sufficient to form an interference fit with the ends of the tube for trapping the plug of the string of lights in the slot.

The tube may be of an oblong shape and have a circumference that is an integer multiple of one-third of the distance between lights of the light string. The use of a proper integer multiple allows the lights of the light string to reside in lateral alignment along the length of the tube. Providing lateral alignment of the lights simplifies use of the light holder by manufacturers in automated loading processes.

Where the circumference is chosen to be twice the distance between lights or two-thirds the distance between lights, two rows of lights reside on opposite sides of the tube. Where the rows reside on the edges of the oblong shape, a particularly efficient means of storage results. A container for a holder in such case is particularly easy to make by a manufacturer and reuse by a consumer.

DETAILED DESCRIPTION OF A PREFERRED EMBODIMENT

Figure 1:
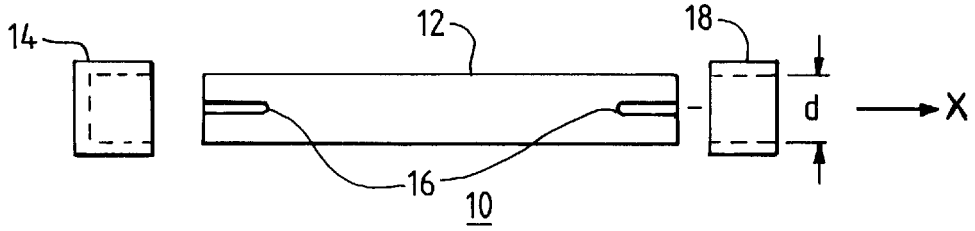
FIG. 1 is an exploded view of a novel holder for light strings under an embodiment of the invention.
Figure 2:
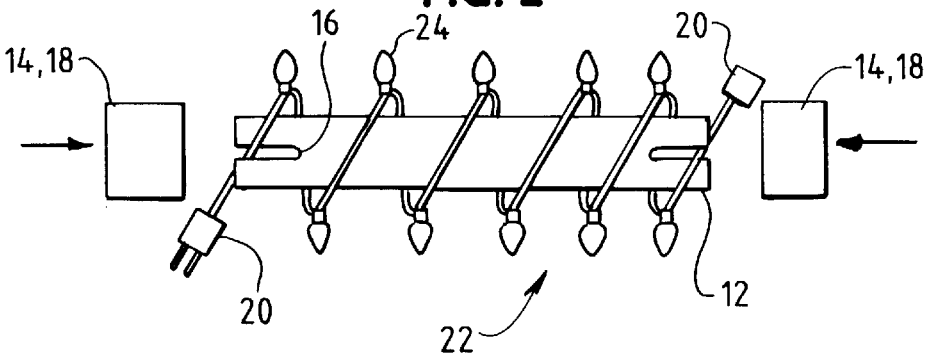
FIG. 2 is a perspective view of the holder of FIG. 1 with a string of lights wound onto the holder.

FIG. 1 is an exploded view of a holder 10 for light strings, generally, under an embodiment of the invention. The holder 10 includes a tube 12 for winding the string of lights 22 around (FIG. 2) and a slot 16 at each end. The slot 16 is used to secure a plug 20 of the string of lights to each end of the holder 10 to prevent the string 22 from unwinding. A keeper 14, 18 is placed over the opposing ends to trap the plug 20 of the string within the slot 16 of the holder 10.

To use the holder 10, a user first places one end of the light string 22 in a slot 16 on one end of the tube 12, with a plug 20 inside the tube 12 and the remainder of the light string 22 outside the tube 12. The user then places a keeper 14, 18 over the end to trap the plug 20 inside the slot 16. The light string 22 then may be wound around the tube 12 towards the opposing end. As the user completes the winding process, he places the remaining plug 20 inside the tube 12 through the slot 16 on the opposing end. The process is completed by placing a keeper 14, 18 over the opposing end to trap the second end of the light string 22 in the slot 16.

Under the embodiment, a tube 12 of an appropriate diameter is provided with an open-ended slot 16 extending inward towards a center portion from each end. The tube 12 may be fabricated of any convenient, lightweight material (e.g., plastic, PVC, metal, etc.). The slot 16 is aligned substantially parallel to a longitudinal axis of the tube 12 and may be created using any appropriate method of fabrication (e.g., milling, sawing, molding, etc.).

The holder 10 may also include a keeper at each end of the tube 12 closing the open end of the slot 16. The keeper may be an closed ended sleeve (e.g., end cap) 14 or an open-ended sleeve 18. The keeper 14, 18 is chosen of a inner diameter, d, of an appropriate size to form an interference fit with an outside of the tube 12 when engaging an end of the tube 12.

Figure 3:
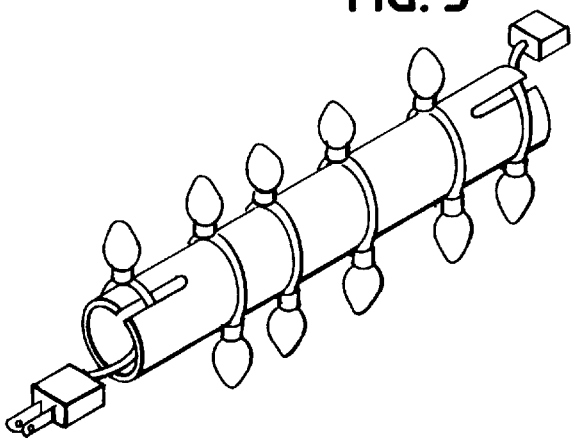
FIG. 3 is a perspective view of the holder of FIG. 1 with the lights of the string of lights in lateral alignment.

The diameter of the tube 12 may be selected to be of convenient size to avoid excessive bending of the wires of the string 22. The diameter may also be selected of such size that the lights 24 of the string 22 are in lateral alignment (FIG. 3) and form a longitudinal line of lights 24 down the length of the tube 12. To achieve lateral alignment of the lights 24 the circumference of the tube 12 may be chosen to be an integer multiple of one-third, or one-quarter of the distance between lights 24 of the string 22.

For example, if the spacing between lights were 6 inches, then choosing a tube circumference of 4 inches would result in two lines of lights 24 on each side of the tube 12. Further, the lines of lights would reside on opposing sides of the tube 12 resulting in a particularly efficient structure for stacking.

Positioning the lights in lateral alignment provides other benefits in addition to efficient stacking. The lateral positioning of the lights allows a user to quickly and easily check for burned-out bulbs by sighting down the lateral array. Further, the line of bulbs allows for more efficient bulb replacement since the line of bulbs (including the socket of any burned-out bulb) may be more easily grasped between a user's thumb and forefinger.

Figure 4:
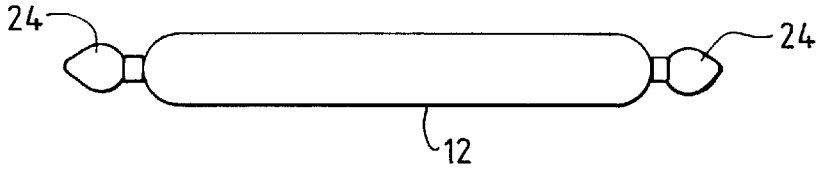
FIG. 4 is an end view of a tube of the light holder of FIG. 1.

While the cross-sectional shape of the tube 12 may be round or rectangular, the tube 12 may also be oblong, as shown in FIG. 4. Where the circumference of the tube 12 is chosen to be two-thirds the distance between lights 24, the particularly compact storage arrangement shown in FIG. 4 results.

Forming the tube 12 into the oblong shape as shown in FIG. 4 with a circumference of two-thirds the light spacing allows the holder 10 to be stored in a cushioned container 26 (FIG. 5), that is both reusable and also highly space efficient. The container 26 may be any appropriate material (e.g., styrofoam, plastic, etc.) that may be easily and inexpensively formed into the proper shape.

Figure 5:
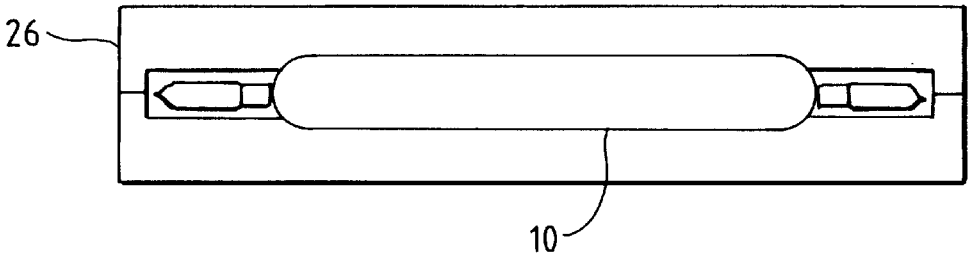
FIG. 5 is an end view of a light holder of FIG. 1 in a cushioned package.
Figure 6:
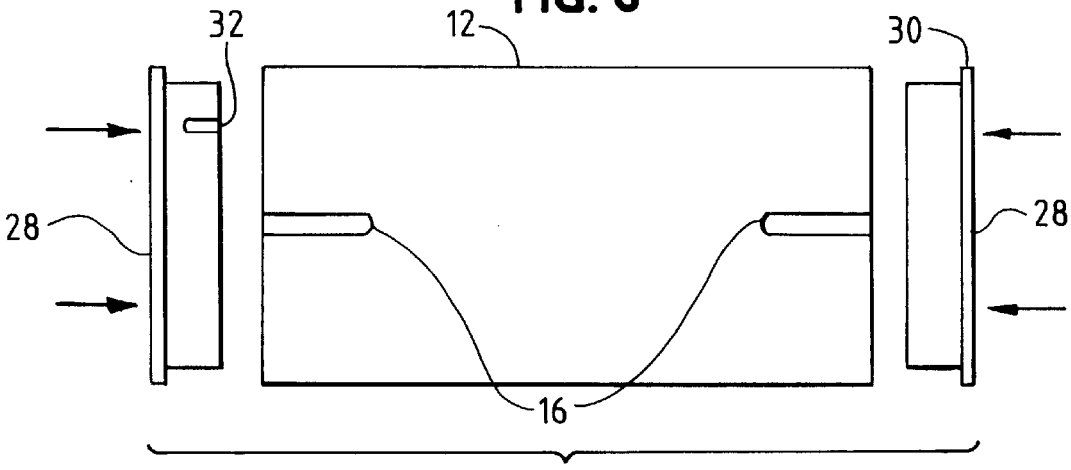
FIG. 6 is a top view of the holder of FIG. 5.

To further conserve space, the keepers of FIG. 5 may be in the form of plugs 28 fitting inside the tube 12, thereby trapping the plug 20 inside the tube 12. The plugs 28 may be formed of styrofoam (FIG. 6) and fit inside the tube 12 of FIGS. 5 and 6 with an interference fit. To aid in removal of the styrofoam keepers 28, a shoulder 30 may be provided along an outside edge of the keeper 28.

In another embodiment of the invention, the keepers 28 may be provided with slots in the form of notches 32, as an alternative to the slots 16 in the tube 12. As with the slots 16, the notches 32 allow the keeper 28 to trap a plug 20 of the light string 22 inside the tube 12. Further, the notches 32 may be provided at a number of locations around the periphery of the keepers 28. Using the notches 32 instead of the slots 16 allows the tube 16 to be made of a thinner material while providing a comparable structure rigidity.

The use of a tube 12 and keepers 14, 18, 28 provides a device for storing light strings 22 that is simple to use and economical. While notches could be provided along the length of the tube 12, the absence of notches is not seen as a detriment in allowing the tube 12 to be loaded by automated machinery used for manufacture of the light strings 22. The simplicity of installation of the keepers 14, 18, 28 further facilitates the adaptability of the light holder 10 to manufacturing processes.

Figure 7:
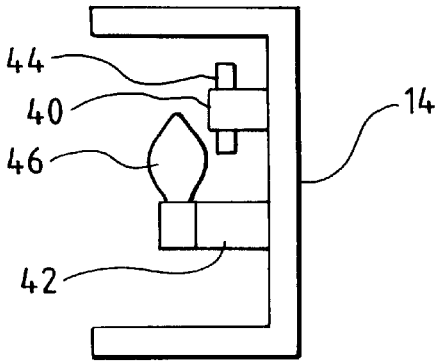
FIG. 7 is a side view of a keeper of FIG. 1 under an alternate embodiment.

In another embodiment of the invention (FIG. 7), clips 40, 42 may be attached to the inside of the keeper 14. A first clip of a first size may be selected for retaining (and storing) spare fuses 44. A second clip 42 may be selected for the storage of spare light bulbs 46.

Figure 8:
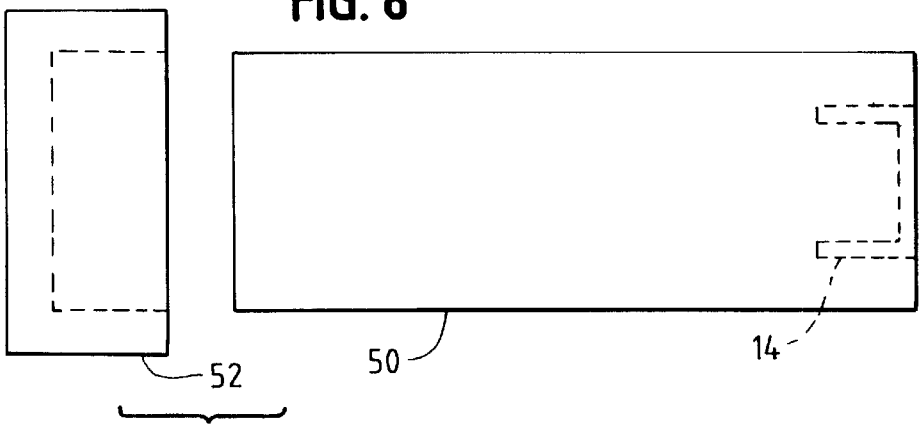
FIG. 8 is an enclosure for the holder of FIG. 1.

In another embodiment of the invention, the keeper 14 (FIG. 8) may be secured to an inside surface of an end of a closed tube 50 as shown in FIG. 8 which itself may become a tubular inclosure for the holder 10. Under the embodiment, a user secures a first end of a string of lights to a first end of the tube 12 with a first keeper. Upon completion of winding the lights onto the tube 12, the user insert the free end of the tube 12 into the enclosure 50, engaging the keeper 14 secured within the enclosure 50 at a second end of the tube 12. A larger enclosure cap 52 may be place over the open end of the enclosure 50 to further protect the holder 10.

Figure 9:
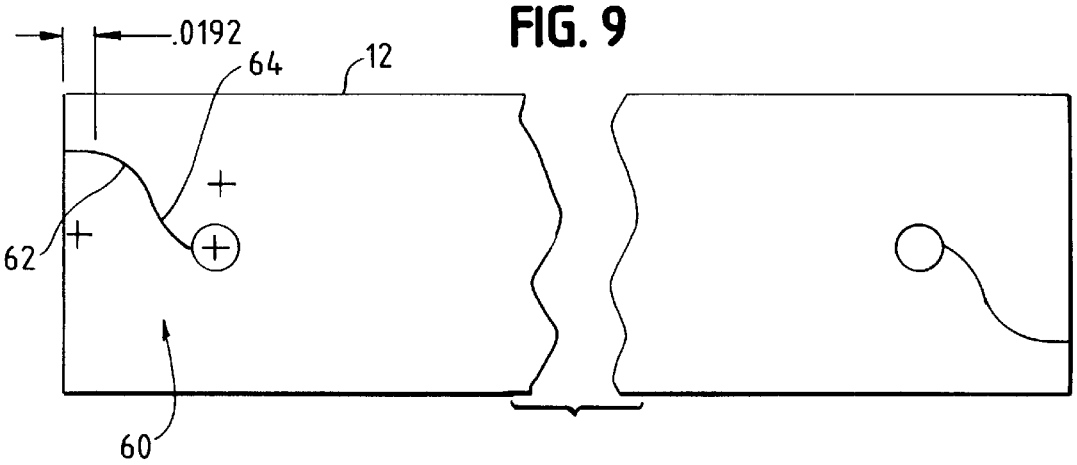
FIGS. 9, 10 and 11 are side views of additional embodiments of the invention.

In another embodiment of the invention (FIG. 9), the elongated tube 12 has a circular cross-section. A slot 60 is formed on one or both ends of the tube 12. The slot 60 is open-ended extending from the end of the tube 12 towards a central section. Under the embodiment the slot 60 forms a curved portion 62 and a recurved portion 64.

Figure 10:
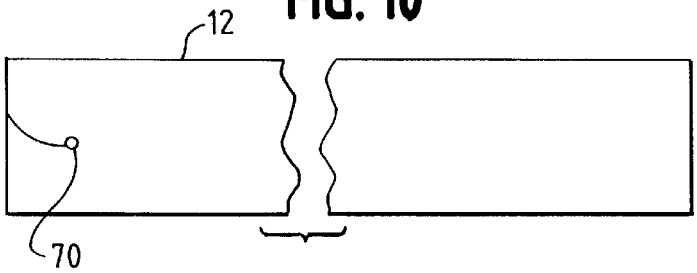

In another embodiment of the invention (FIG. 10), the slot 70 is formed of a single curve. The curve 70, as shown, is open ended and may extend inwards from one or both ends of the elongated tube 12.

Forming the end slots 60, 70 in a curved shape allows any slack in the wound string of lights to be to be absorbed as the plug is inserted into the slot 60, 70. Where the slack is very small, the plug may only need to be inserted a short distance into the open-ended slot 60, 70. Where the slot is more substantial, the plug may be inserted all the way to the closed ends of the slot to further take up extra slack in the wound string of lights.

Figure 11:
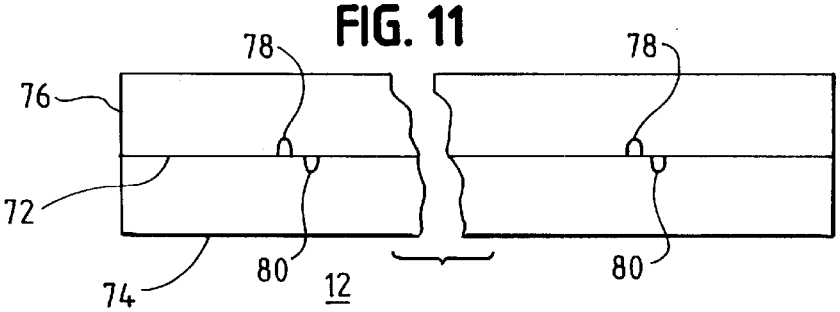

In another embodiment of the invention (FIG. 11), the tube 12 may be formed as a two-piece assembly 74, 76, split longitudinally along a longitudinal axis 72. When assembled, the tube 12 may be held together by interlocking tabs 78, 80.

Forming the tube 12 as a two-piece assembly allows the tube 12 to be stored in a compact form when not in use. Further, the use of the interlocking tabs 78, 80 allows the tube 12 to be cooperatively held together by the string of lights while in use. Further, since the two halves 74, 76 are held together by the string of lights and since the ends of the string of lights are held to the tube 12 by the end slots, the completed assembly of lights and tube for a rugged self-supporting unit that may be subject to severe vibration during shipping without fear of the assembly falling apart. Such assembly has great utility in reducing shipping losses for manufacturers of Christmas tree lights.

A specific embodiment of a holder for light strings according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

I claim:

1. A holder for a string of lights comprising:

an elongated tube having an outer circumference convenient for winding the string of lights around;

an open-ended slot parallel to a predominant axis of the tube extending from an end of the tube towards a central portion for receiving an end plug of the string of lights;

an end cap which closes an open end of the open-ended slot thereby trapping the plug of the string of lights in the slot; and a pair of fuse holder clips disposed within the end cap.

2. A holder for a string of lights comprising:

an elongated tube having an outer circumference convenient for winding the string of lights around;

an open-ended slot parallel to a predominant axis of the tube extending from an end of the tube towards a central portion for receiving an end plug of the string of lights;

an end cap which closes an open end of the open-ended slot thereby trapping the plug of the string of lights in the slot; and a pair of light holder clips disposed within the end cap.

* * * * *